US007328633B2

(12) United States Patent
Lin

(10) Patent No.: US 7,328,633 B2
(45) Date of Patent: Feb. 12, 2008

(54) DEVICE FOR SWITCHING WRENCHING DIRECTION OF A RATCHET WHEEL OF A RATCHET TOOL

(75) Inventor: Chun-Lang Lin, Dali (TW)

(73) Assignee: Advance Team Power Inc., Taichung County (TW)

( * ) Notice: Subject to any disclaimer, the term of this patent is extended or adjusted under 35 U.S.C. 154(b) by 0 days.

(21) Appl. No.: 11/442,172

(22) Filed: May 30, 2006

(65) Prior Publication Data

US 2007/0277653 A1 Dec. 6, 2007

(51) Int. Cl.
*B25B 13/46* (2006.01)

(52) U.S. Cl. ..... 81/63.1; 192/43.1

(58) Field of Classification Search ..... 81/61–63.2; 192/43.1, 43.2

See application file for complete search history.

(56) References Cited

U.S. PATENT DOCUMENTS 6,044,731 A * 4/2000 Hsieh ..... 81/63.2
6,260,448 B1 * 7/2001 Chaconas ..... 81/63
6,516,691 B1 * 2/2003 Wei ..... 81/63.2
6,789,449 B2 * 9/2004 Liu ..... 81/63.2
2002/0166417 A1 * 11/2002 Hu ..... 81/63.2
2003/0005795 A1 * 1/2003 McCann ..... 81/63.2
2003/0177872 A1 * 9/2003 Shu-Ying et al. ..... 81/63.2
2006/0090609 A1 * 5/2006 Chang ..... 81/63.2

* cited by examiner

*Primary Examiner*—D S Meislin
(74) *Attorney, Agent, or Firm*—Rosenberg, Klein & Lee

(57) ABSTRACT

A device for switching wrenching direction of a ratchet wheel of a ratchet tool. A ratchet wheel and a pawl are accommodated in a receiving cavity of the main body of the ratchet tool. The receiving cavity is covered by a cover board for hindering the ratchet wheel and the pawl from dropping out of the receiving cavity. A shift member is disposed on the pawl. The cover board is formed with a locating slot corresponding to the shift member. The locating slot has a first locating section and a second locating section. After the shift member is shifted to move the pawl and switch the wrenching direction, the shift member can be selectively located in the first locating section or the second locating section.

3 Claims, 9 Drawing Sheets

DEVICE FOR SWITCHING WRENCHING DIRECTION OF A RATCHET WHEEL OF A RATCHET TOOL

BACKGROUND OF THE INVENTION

The present invention is related to a device for switching wrenching direction of a ratchet wheel of a ratchet tool, and more particularly to a device for switching wrenching direction of a ratchet wheel of a ratchet tool, which has simplified components and can be assembled at lower cost.

FIG. 9 shows a conventional ratchet wrench having a main body 7. A ratchet wheel 71 is accommodated in the head section of the main body 7. In addition, in the head section are disposed a pawl 72 engaged with the ratchet wheel 71 and a shift member 72 for driving the pawl 72. One end 711 of the ratchet wheel 71 protrudes from the head section of the main body 7. Via a retainer member 74, the end 711 is pivotally connected with a controlling button 75. The controlling button 75 serves to drive the shift member 73 to bias the pawl 72 left or right so as to switch the wrenching direction of the ratchet wrench.

The above conventional ratchet wrench includes numerous components each of which must be precisely processed. Therefore, the manufacturing cost of such ratchet wrench is relatively high and the competitive capacity of such product on the market is relatively low. In addition, the numerous components lead to heavy weight of the ratchet wrench. It is inconvenient to operate such heavy ratchet wrench.

Besides, the controlling button 75 is pivotally connected with the end 711 of the ratchet wheel 71. A complicated fixing unit 76 is arranged for locating the controlling button 75 and preventing the controlling button 75 from displacing. In addition, it is necessary to precisely design the structure of the controlling button 75 for well pivotally connecting with the ratchet wheel 71. As a result, the manufacturing cost will be further increased. Furthermore, when used in a dirty working site, the pivoted sections of the controlling button 75 and the ratchet wheel 71 are often contaminated and clogged. Under such circumstance the controlling button 75 can be hardly well pivotally connected with the ratchet wheel 71. Consequently, in operation, a user can hardly truly switch the wrenching direction via the controlling button 75.

Moreover, the above ratchet wrench lacks any component for reciprocating the pawl 72. Therefore, the pawl 72 tends to stick with the ratchet wheel 71 and hinder the ratchet wheel 71 from rotating in reverse direction.

SUMMARY OF THE INVENTION

It is therefore a primary object of the present invention to provide a device for switching wrenching direction of a ratchet wheel of a ratchet tool. The components of the device are simplified so that the manufacturing cost is lowered and the assembling time is shortened. In addition, the weight of the ratchet tool is reduced to facilitate the operation thereof.

It is a further object of the present invention to provide the above device for switching wrenching direction of the ratchet wheel of the ratchet tool, in which the shape of the locating slot is adapted to the shape of the shift member for locating the same. Therefore, the locating slot can be directly formed on the head section without designing any additional complicated locating component. Also, the resilient member not only resiliently pushes the shift member to chuck in the locating section, but also permits the pawl to radially reciprocally move. This more simplifies the structure of the ratchet tool.

According to the above objects, the device for switching wrenching direction of the ratchet wheel of the ratchet tool of the present invention includes:

a main body having a head section at a first end, the head section being formed with a receiving cavity;

a ratchet wheel accommodated in the receiving cavity, multiple ratchets being annularly arranged on a middle section of the ratchet wheel, a second end of the ratchet wheel being a working end extending out from the head section of the main body;

a pawl accommodated in the receiving cavity of the main body and adjacent to the ratchet wheel, the pawl being controllably left and right movable within the receiving cavity, a first side of the pawl being formed with multiple ratchets facing the ratchet wheel for engaging with the ratchets of the ratchet wheel, the pawl being equipped with a resilient member for radially reciprocally moving the pawl; and a shift member, a first end of the shift member being connected with the pawl, a second end of the shift member being a shift end extending out of the head section of the main body for a user to directly shift the pawl left and right, the head section of the main body having a locating slot corresponding to the shift end of the shift member, the shift end extending through the locating slot to outer side of the head section, the locating slot having a first locating section and a second locating section, whereby the shift end of the shift member can be selectively located in the first locating section or the second locating section after the pawl is shifted via the shift member.

The present invention can be best understood through the following description and accompanying drawings wherein:

DETAILED DESCRIPTION OF THE PREFERRED EMBODIMENTS

Figure 1:
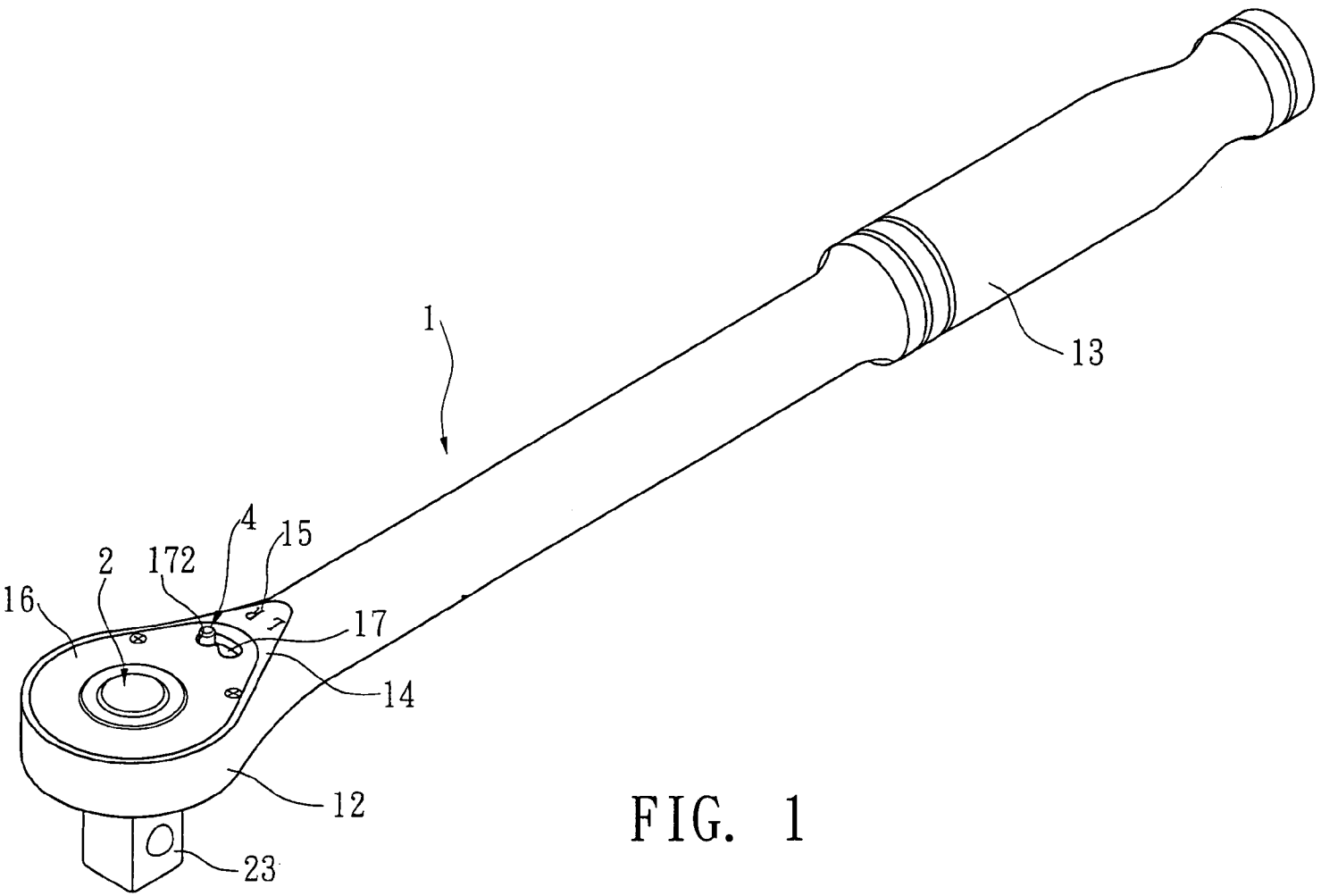
FIG. 1 is a perspective assembled view of the present invention.
Figure 2:
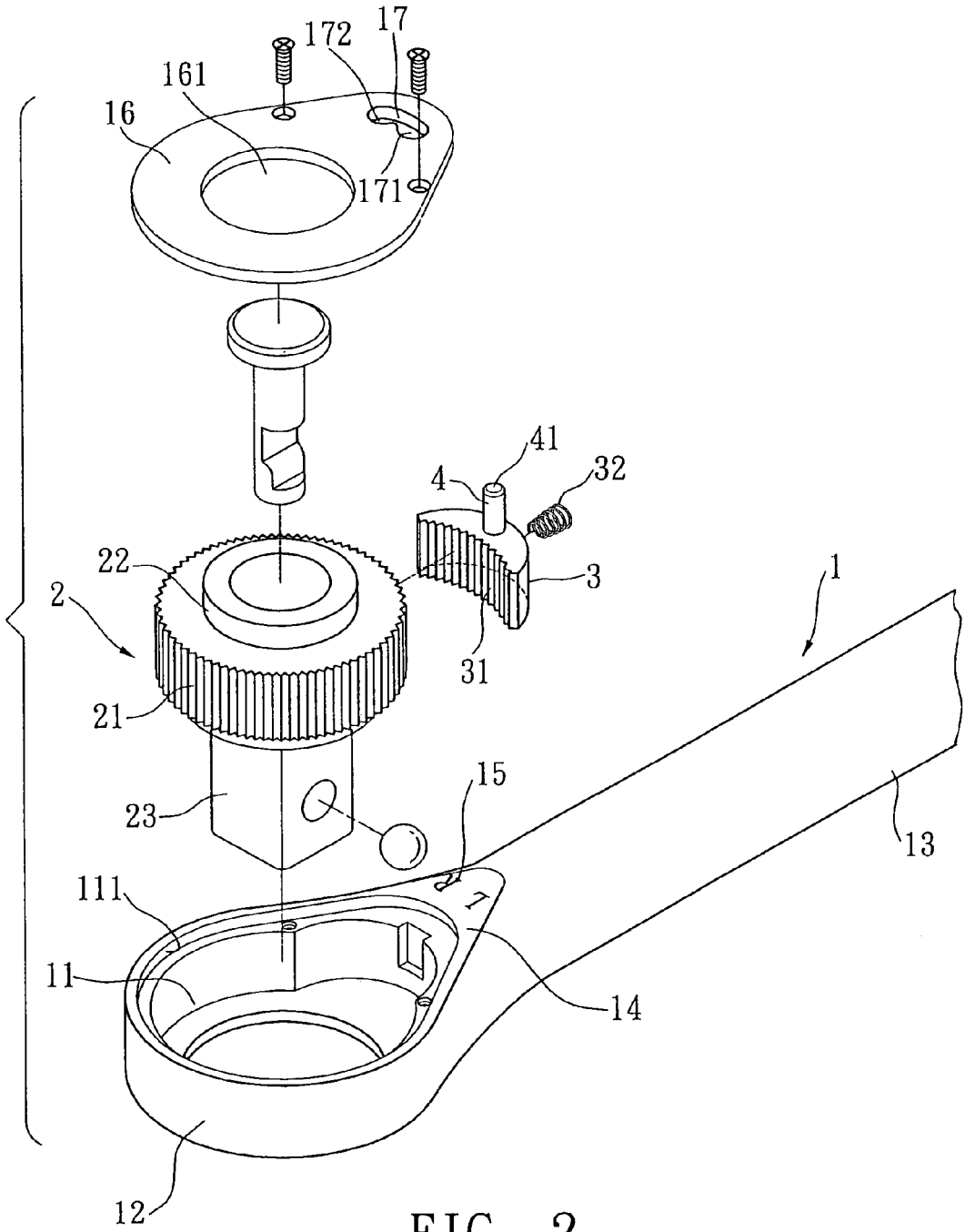
FIG. 2 is a perspective exploded view of the present invention.
Figure 3:
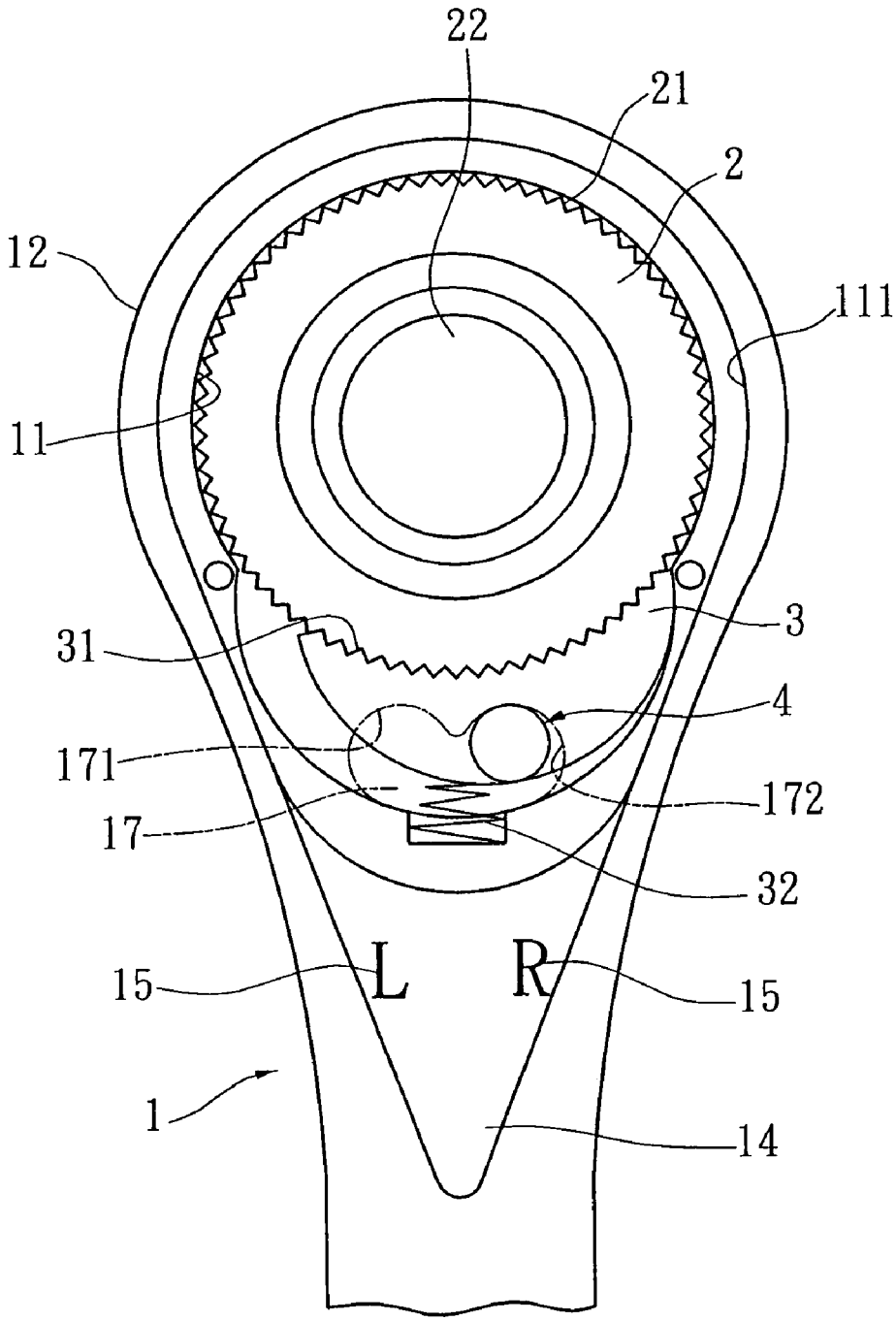
FIG. 3 is a top sectional assembled view of the present invention.

Please refer to FIGS. 1 to 3. With a ratchet wrench exemplified, the device for switching the wrenching direction of the ratchet wheel of the ratchet tool of the present invention includes a main body 1, a ratchet wheel 2, a pawl 3 and a shift member 4.

A first end of the main body 1 has a head section 12. A second end of the main body 1 is a handle 13 for a user to hold and drive the head section 12. The head section 12 is formed with a receiving cavity 11 having an opening 111. The ratchet wheel 2 and the pawl 3 are accommodated in the receiving cavity 11. The opening 111 is covered by a cover board 16 for closing the opening 111 and hindering the ratchet wheel 2 and the pawl 3 from dropping out of the receiving cavity 11. A plane face 14 is formed on one side of the receiving cavity 11 of the head section. The plane face 14 is marked with marks R and L 15.

The ratchet wheel 2 is accommodated in the receiving cavity 11 of the main body 1. Multiple ratchets 21 are annularly arranged on a middle section of the ratchet wheel 2. A first end of the ratchet wheel 2 proximal to the opening 111 of the receiving cavity 11 is a fitting end 22. The cover board 16 is formed with a fitting hole 161 adapted to the fitting end 22, whereby the fitting end 22 can be fitted in the fitting hole 161. A second end of the ratchet wheel 2 is a working end 23 extending out from the head section 12 of the main body 1.

The pawl 3 is accommodated in the receiving cavity 11 of the main body 1 and adjacent to the ratchet wheel 2. The pawl 3 is controllably left and right movable. A first side of the pawl 3 is formed with multiple ratchets 31 facing the ratchet wheel 2 for engaging with the ratchets 21 of the ratchet wheel 2. The pawl 3 is equipped with a resilient member 32 for radially reciprocally moving the pawl 3. In this embodiment, the resilient member 32 is a compression spring. A first end of the resilient member 32 abuts against a second end of the pawl 3. A second end of the resilient member 32 is inlaid in a wall of the receiving cavity 11 of the main body 1.

A first end of the shift member 4 is connected with the pawl 3. A second end of the shift member 4 is a shift end 41 extending out of the head section 12 of the main body 1 for a user to directly shift the pawl 3 left and right. The head section 12 of the main body 1 has a locating slot 17 corresponding to the shift end 41 of the shift member 4. The shift end 41 extends through the locating slot 17 to outer side of the head section 12. The locating slot 17 has a first locating section 171 and a second locating section 172. The shift end 41 of the shift member 4 can be selectively located in the first locating section 171 or the second locating section 172 after the pawl 3 is shifted via the shift member 4. The two marks 15 are respectively positioned on two sides of the locating slot 17 corresponding to the first locating section 171 and the second locating section 172. In this embodiment, the shift member 4 is a cylindrical column protruding from a first end of the pawl 3 toward the cover board 16. The locating slot 17 is formed on the cover board 16. The first locating section 171 and the second locating section 172 are arced recesses. The resilient member 32 serves to push the pawl 3 to make the shift end 41 of the shift member 4 chucked in one of the locating sections 171, 172 so as to locate the pawl 3.

Figure 4:
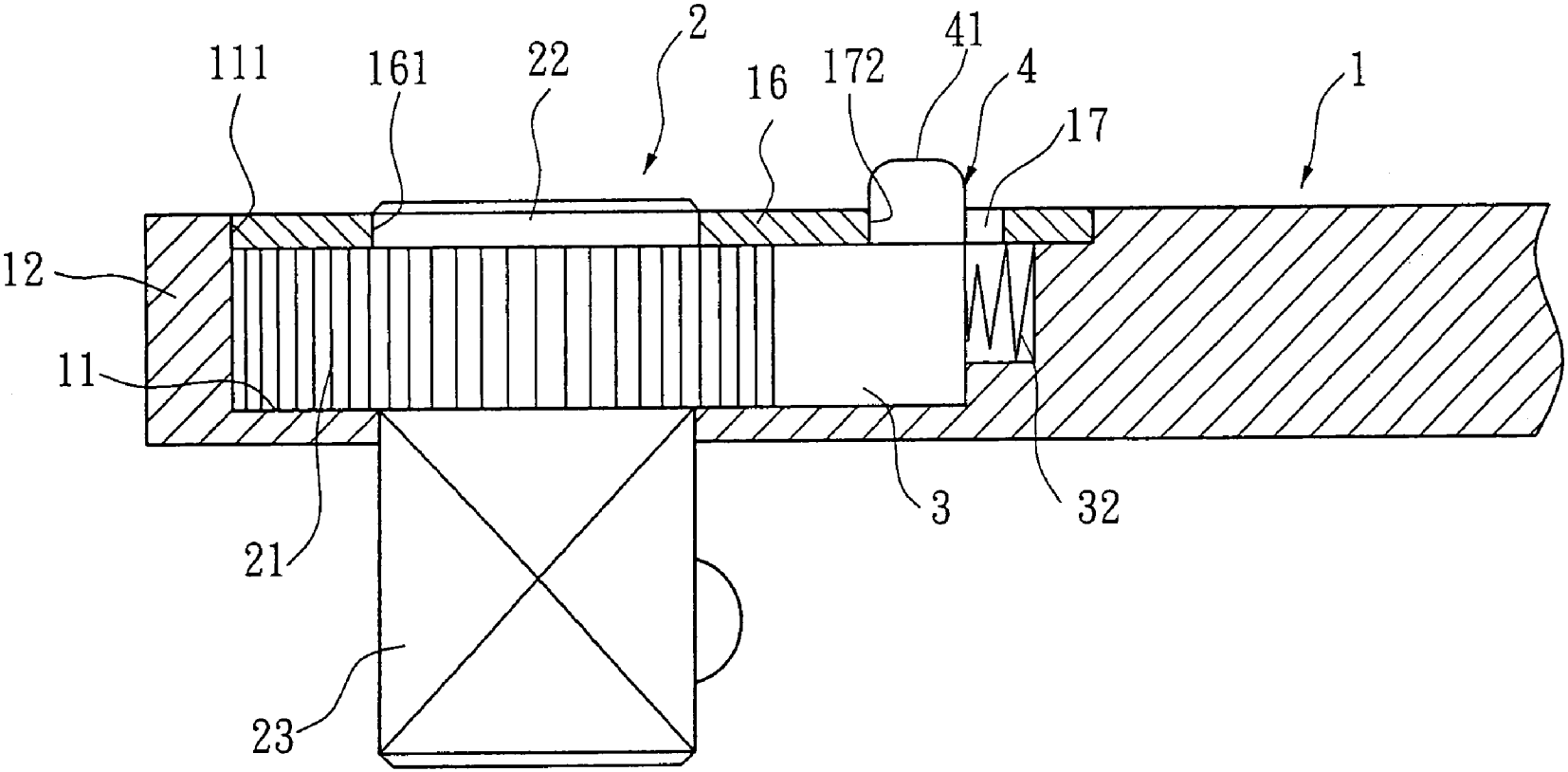
FIG. 4 is a side sectional view of the present invention.

In operation, as shown in FIGS. 3 and 4, a user can conveniently shift the shift end 41 of the shift member 4, which is exposed to outer side of the head section 12 of the main body 1. When shifting the shift end 41, the pawl 3 is directly driven to move left or right to change the position where the ratchets 31 of the pawl 3 are engaged with the ratchets 21 of the ratchet wheel 2. Accordingly, the wrenching direction can be switched. After the shift member 4 is shifted, the pawl 3 is resiliently pushed by the resilient member 32 to make the shift end 41 located in the other locating section 171, 172 so as to fix the pawl 3 after switched.

According to the above arrangement, the components of the present invention are such simplified that the pawl is directly driven by the shift member. Therefore, the manufacturing cost is lowered and the assembling time is shortened. In addition, the weight of the ratchet tool is reduced to facilitate the operation thereof.

Moreover, the shape of the locating slot is adapted to the shape of the shift member for locating the same. Therefore, the locating slot can be directly formed on the head section without designing any additional complicated locating component. Also, the resilient member not only resiliently pushes the shift member to chuck in the locating section, but also permits the pawl to radially reciprocally move. This simplifies the structure of the ratchet wrench.

In addition, the marks R, L marked on the plane face of the head section on two sides of the locating slot clearly indicate the wrenching directions to a user.

Figure 5:
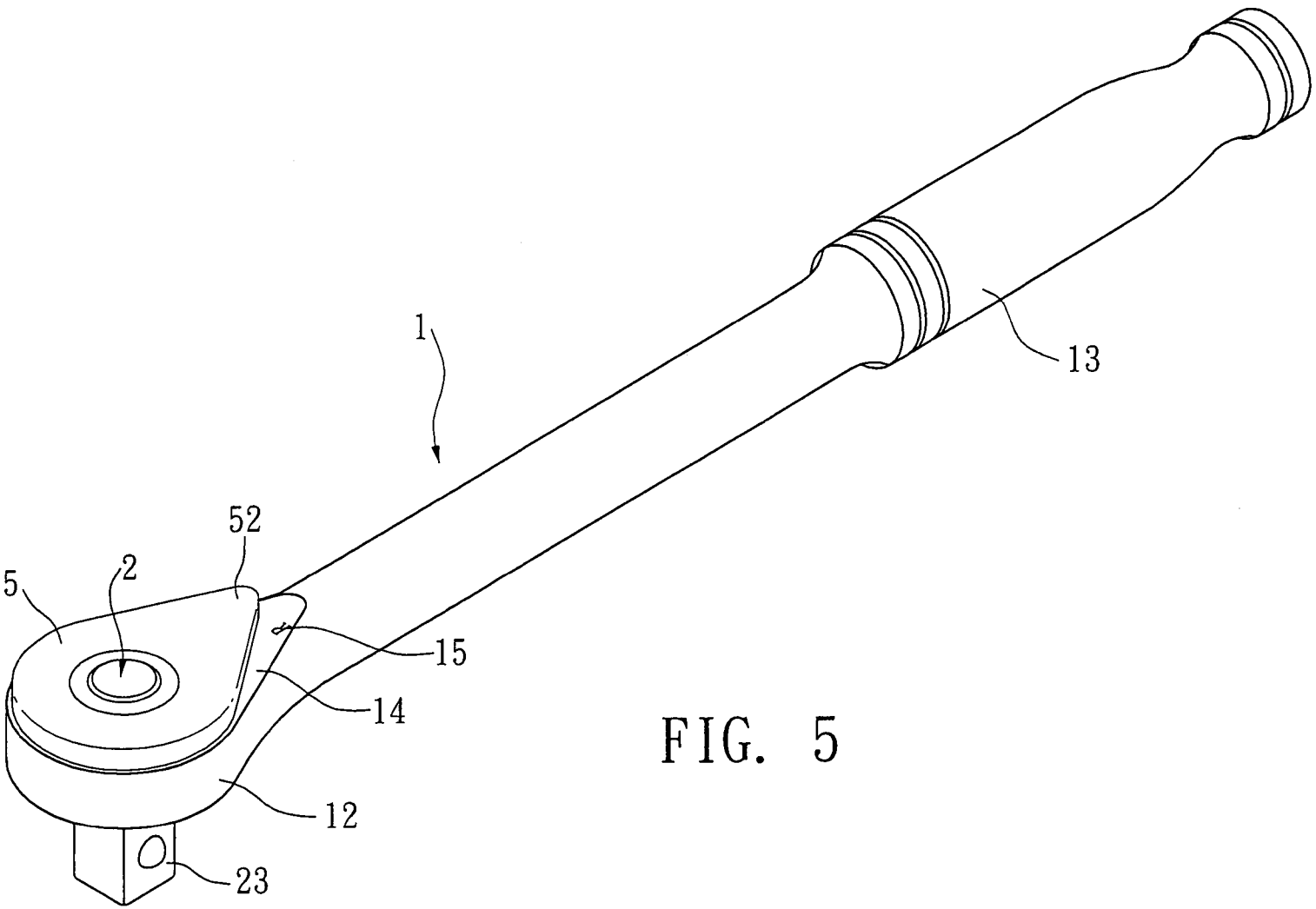
FIG. 5 is a perspective assembled view of a second embodiment of the present invention.
Figure 6:
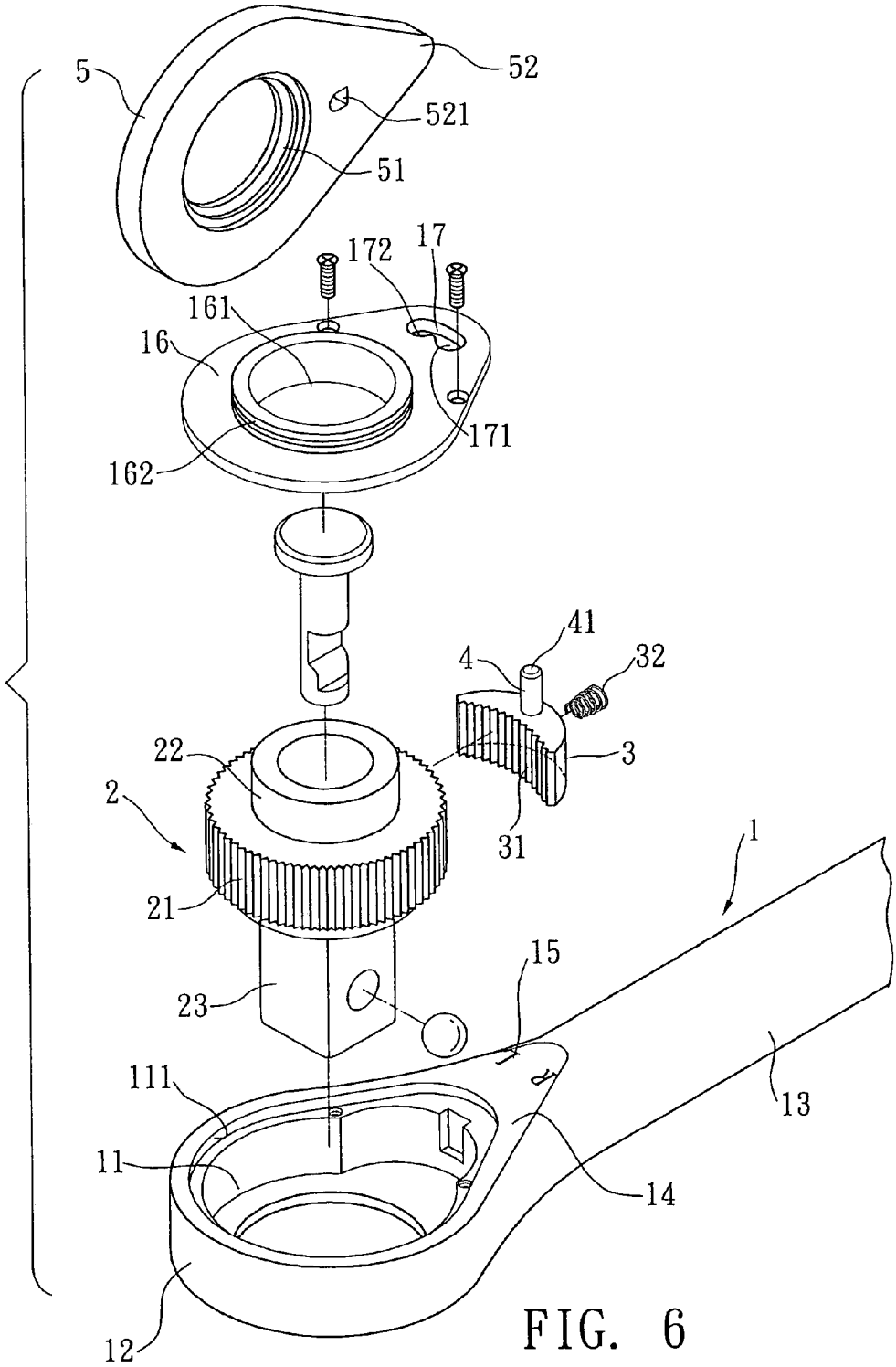
FIG. 6 is a perspective exploded view of the second embodiment of the present invention.
Figure 7:
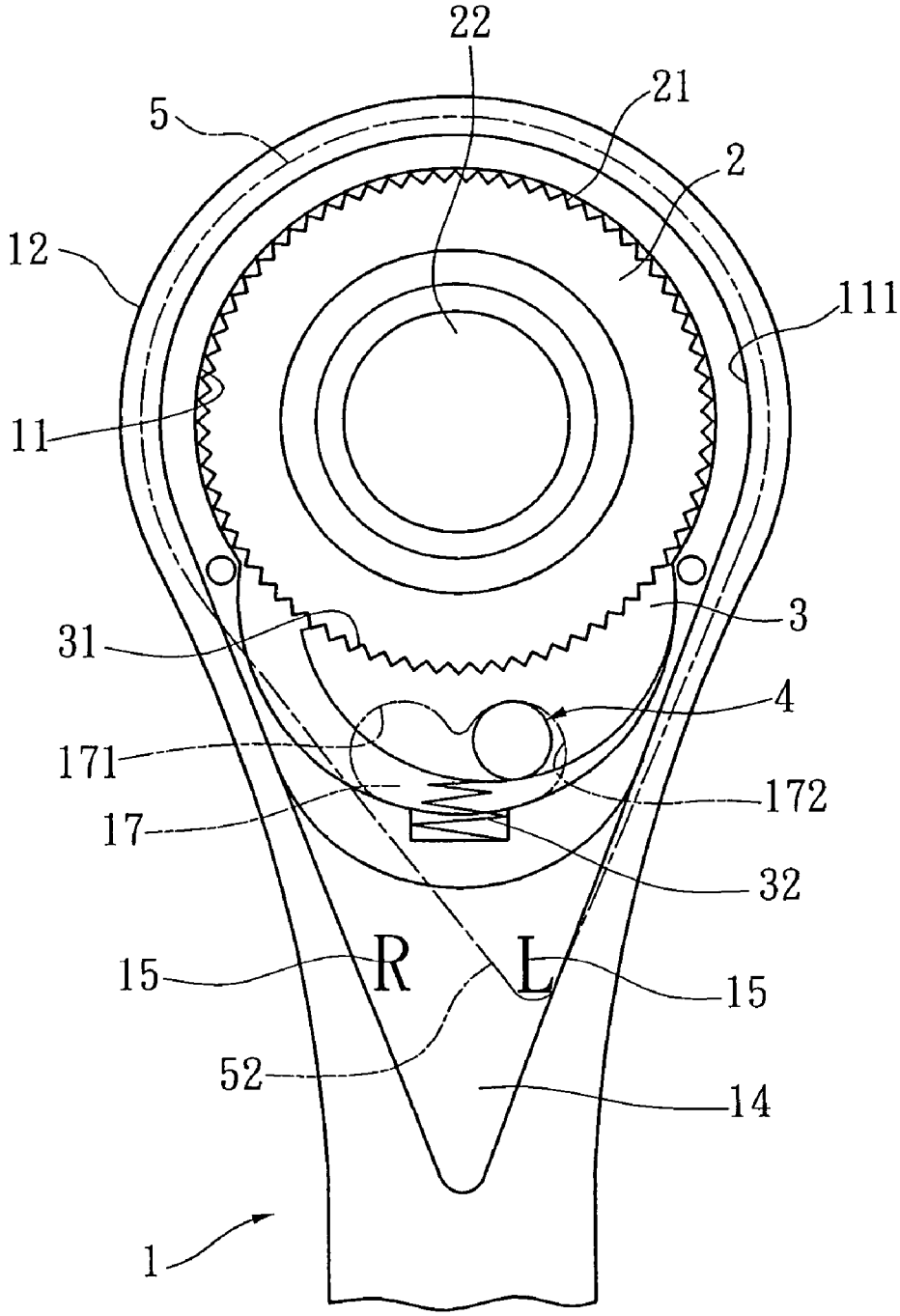
FIG. 7 is a top sectional assembled view of the second embodiment of the present invention.

FIGS. 5 to 7 show a second embodiment of the present invention, which further includes a controlling button 5. The controlling button 5 is pivotally connected with a first face of the head section 12 of the main body 1 and faces the first end of the shift member 4. The controlling button 5 is connected with the shift end 41 of the shift member 4 for controlling the shift member 4. In this embodiment, a pivotal hub 162 axially extends from the circumference of the fitting hole 161 of the cover board 16. The controlling button 5 is formed with a pivotal hole 51 and a controlling handle 52. The pivotal hub 162 is pivotally fitted in the pivotal hole 51, whereby the controlling button 5 is pivotally connected with the cover board 16 and the controlling handle 52 can be swung left and right about the pivotal hub 162. The controlling handle 52 is connected with the shift end 41 of the shift member 4 for controlling the pawl 3 to shift left and right. In this embodiment, the bottom face of the controlling handle 52 of the controlling button 5 is formed with a connecting hole 521 corresponding to the shift end 41. The shift end 41 is fitted in the connecting hole 521, whereby by means of shifting the controlling handle 51, the shift end 41 can be moved to drive the pawl 3. The controlling button 5 has an area covering the entire area of the cover board 16. In addition, the controlling handle 52 of the controlling button 5 is tapered and right positioned above the plane face 14 of the head section 12 of the main body 1. The controlling handle 52 can shade one of the marks 15.

Figure 8:
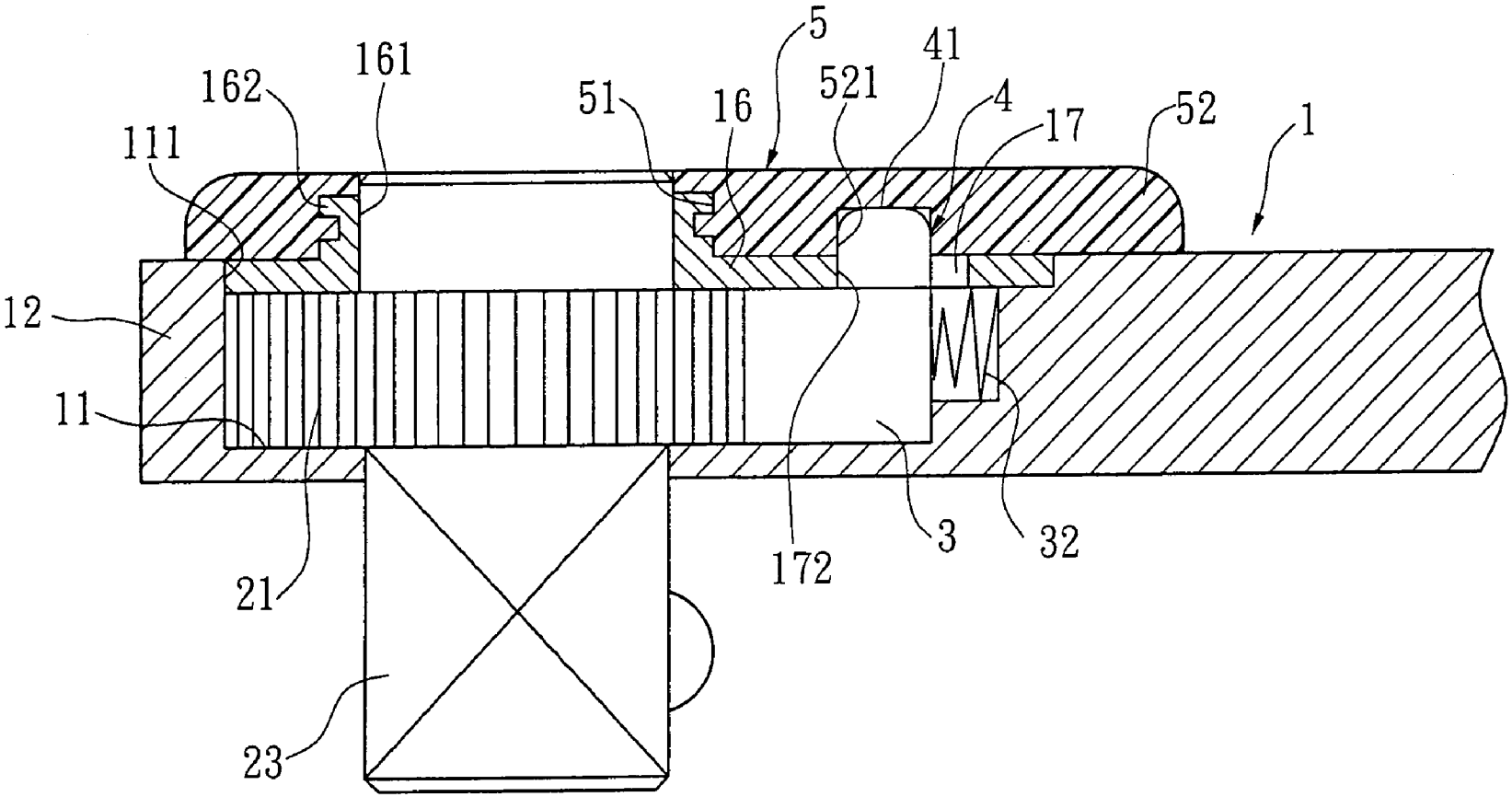
FIG. 8 is a side sectional view of the second embodiment of the present invention.
Figure 9:
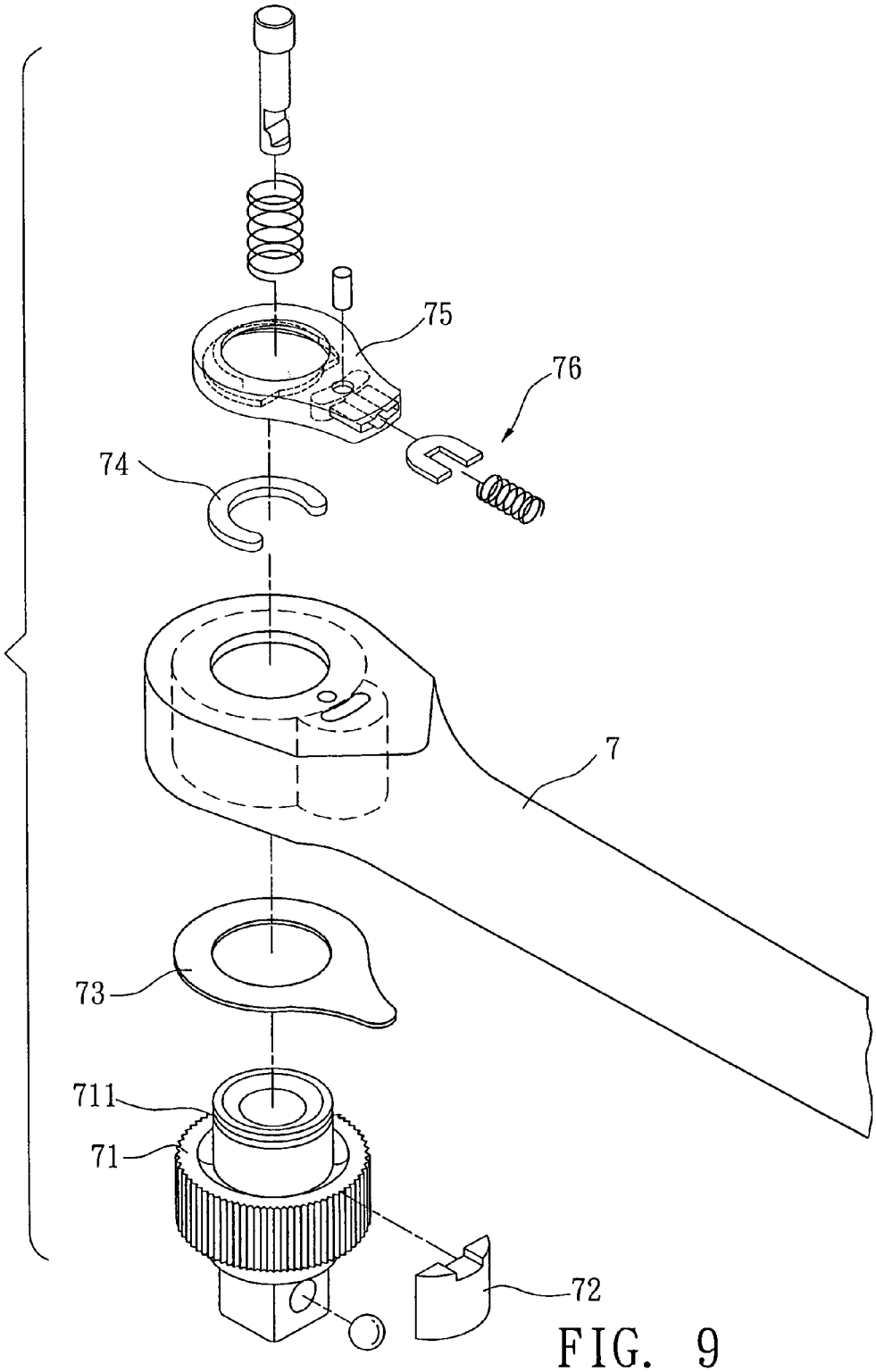
FIG. 9 PRIOR ART
FIG. 9 is a perspective exploded view of a conventional ratchet wrench.

In operation, as shown in FIGS. 7 and 8, a user can shift the controlling handle 52 of the controlling button 5, which is connected with the shift end 41 of the shift member 4 to drive the pawl 3 left and right. Accordingly, the user can shift the controlling handle 52 to change the position where the ratchets 31 of the pawl 3 are engaged with the ratchets 21 of the ratchet wheel 2 so as to switch the wrenching direction.

According to the arrangement of the controlling button of the second embodiment, a user can easily shift the pawl. In addition, the area of the controlling button covers the entire area of the cover board to conceal the seam between the cover board and the wall of the receiving cavity. The controlling handle of the controlling button is tapered to a user to conveniently shift. In addition, the profile of the controlling button consists with the profile of the head section of the main body to beautify the appearance.

In addition, the controlling button is pivotally connected with the main body of the ratchet tool for truly driving the pawl and switching the wrenching direction. When the ratchet wheel is rotated, the controlling button will not rotate.

Besides, the controlling handle of the controlling button can shade one of the marks R, L to clearly indicate the wrenching direction to a user.

The above embodiments are only used to illustrate the present invention, not intended to limit the scope thereof.

Many modifications of the above embodiments can be made without departing from the spirit of the present invention.

What is claimed is:

1. A device for switching wrenching direction of a ratchet wheel of a ratchet tool, comprising:

a main body having a head section at a first end, the head section being formed with a receiving cavity;

a ratchet wheel accommodated in the receiving cavity, multiple ratchets being annularly arranged on a middle section of the ratchet wheel, a second end of the ratchet wheel being a working end extending out from the head section of the main body;

a pawl accommodated in the receiving cavity of the main body and adjacent to the ratchet wheel, the pawl being controllably left and right movable within the receiving cavity, a first side of the pawl being formed with multiple ratchets facing the ratchet wheel for engaging with the ratchets of the ratchet wheel, the pawl being equipped with a resilient member for radially reciprocally moving the pawl;

a shift member, a first end of the shift member being connected with the pawl, a second end of the shift member being a shift end extending out of the head section of the main body for a user to directly shift the pawl left and right, the head section of the main body having a locating slot corresponding to the shift end of the shift member, the shift end extending through the locating slot to an outer side of the head section, the locating slot having a first locating section and a second locating section, whereby the shift end of the shift member can be selectively chucked in the first locating section or the second locating section after the pawl is shifted via the shift member; and a controlling button pivotally connected with a first face of the head section of the main body and facing the first end of the shift member, the controlling button being connected with the shift end of the shift member for controlling the shift member;

wherein the receiving cavity of the head section of the main body has an opening covered by a cover board for closing the opening and hindering the ratchet wheel and the pawl from dropping out of the receiving cavity, a plane face being formed on one side of the receiving cavity of the head section, the plane face being marked with marks, a first end of the ratchet wheel proximal to the opening of the receiving cavity being a fitting end, the cover board being formed with a fitting hole adapted to the fitting end, whereby the fitting end is fitted in the fitting hole, the second end of the ratchet wheel being the working end, a first pivot section axially extending from a circumference of the fitting hole of the cover board, the controlling button being formed with a second pivot section and a controlling handle, the second pivot section being pivotally connected with the first pivot section of the cover board, whereby the controlling button is pivotally connected with the cover board and the controlling handle can be swung left and right about the first pivot section, the controlling handle being connected with the shift end of the shift member for controlling the pawl to shift left and right.

2. The device for switching wrenching direction of the ratchet wheel of the ratchet tool as claimed in claim 1, wherein a bottom face of the controlling handle of the controlling button is formed with a connecting hole corresponding to the shift end, the shift end being fitted in the connecting hole, whereby by means of shifting the controlling handle, the shift end can be moved to drive the pawl.

3. The device for switching wrenching direction of the ratchet wheel of the ratchet tool as claimed in claim 1, wherein the controlling button has an area covering the entire area of the cover board, the controlling handle of the controlling button being tapered and right positioned above the plane face of the head section of the main body to shade one of the marks.

* * * * *